US007841864B2

(12) United States Patent
Hsiao et al.

(10) Patent No.: US 7,841,864 B2
(45) Date of Patent: Nov. 30, 2010

(54) ELECTRICAL CONTACT FOR SOCKET CONNECTOR

(75) Inventors: Shih-Wei Hsiao, Tu-Cheng (TW); Wen-Yi Hsieh, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/538,883

(22) Filed: Aug. 11, 2009

(65) Prior Publication Data

US 2010/0035472 A1 Feb. 11, 2010

(51) Int. Cl.
*H01R 12/00* (2006.01)

(52) U.S. Cl. ..... 439/66

(58) Field of Classification Search ..... 439/66, 439/700, 482, 824; 324/754
See application file for complete search history.

(56) References Cited

U.S. PATENT DOCUMENTS 4,385,754 A * 5/1983 Waite ..... 267/71
7,025,602 B1 * 4/2006 Hwang ..... 439/66
7,256,593 B2 * 8/2007 Treibergs ..... 324/754
7,285,026 B1 * 10/2007 Ju et al. ..... 439/700
7,351,121 B2 * 4/2008 Xu ..... 439/824
7,467,952 B2 * 12/2008 Hsiao et al. ..... 439/66
7,559,769 B2 * 7/2009 Hsiao et al. ..... 439/66
2008/0146083 A1 6/2008 Hsiao et al.

* cited by examiner

*Primary Examiner*—T C Patel
*Assistant Examiner*—Harshad C Patel
(74) *Attorney, Agent, or Firm*—Andrew C. Cheng; Wei Te Chung; Ming Chieh Chang

(57) ABSTRACT

An electrical connector (100) includes an insulative housing (2) defining a plurality of passageways (21) and a plurality of contacts (1) received in corresponding passageways. Each contact includes a moveable part (10) forming a pair of guiding beams (105), an immoveable part (20) coupled with the moveable part and a biasing device (30) constantly urging the moveable part away from immoveable part. The immoveable part includes a pair of posts (205) and defines a pair of guiding slots (207). The guiding beams are received in the guiding slots and are capable of moving with regard to the immovable part along opposite surfaces of the immoveable part. The guiding beams and the posts are decussated to surround the biasing device for preventing the biasing device from disengaging therefrom.

17 Claims, 4 Drawing Sheets

ELECTRICAL CONTACT FOR SOCKET CONNECTOR

BACKGROUND OF THE INVENTION

1. Field of the Invention

The present invention relates generally to an electrical socket connector, and more particularly to an electrical socket connector having electrical contacts which electrically connects a plurality of pins of an integrated circuit (IC) provided in a test socket to corresponding pads of a printed circuit board (PCB).

2. Description of Related Arts

U.S. Pat. No. 7,025,602 issued to Hwang on Apr. 11, 2006, discloses an electrical contact for connecting a central processing unit (CPU) with a printed circuit board (PCB). The electrical contact comprises a moveable part, a immoveable part and a spring portion. The spring portion is fitted over a predetermined area between the moveable and immoveable parts and provides resilient force therebetween. Whether the moveable part contacts with the immoveable part or not depends on the resilient force of the spring portion. In order to meet the minimization of the electrical contact, both the moveable part and the immoveable part are required to reduce its dimension. With a smaller dimension, the moveable part and the immoveable part are so thin that they have no enough rigidity, which easily causes damage to the electrical contact.

Hence, an electrical contact having much more rigidity while keeping in small dimension is desired.

SUMMARY OF THE INVENTION

Accordingly, an object of the present invention is to provide an electrical contact having much more rigidity while keeping in small dimension.

To achieve the above object, an electrical connector includes an insulative housing defining a plurality of passageways and a plurality of contacts received in corresponding passageways. Each contact includes a moveable part forming a pair of guiding beams, an immoveable part coupled with the moveable part and a biasing device constantly urging the moveable part away from immoveable part. The immoveable part includes a pair of posts and defines a pair of guiding slots. The guiding beams are received in the guiding slots and are capable of moving with regard to the immovable part along opposite surfaces of the immoveable part. The guiding beams and the posts are decussated to surround the biasing device for preventing the biasing device from disengaging therefrom.

Other objects, advantages and novel features of the invention will become more apparent from the following detailed description when taken in conjunction with the accompanying drawings.

DETAILED DESCRIPTION OF THE PREFERRED EMBODIMENT

Figure 1:
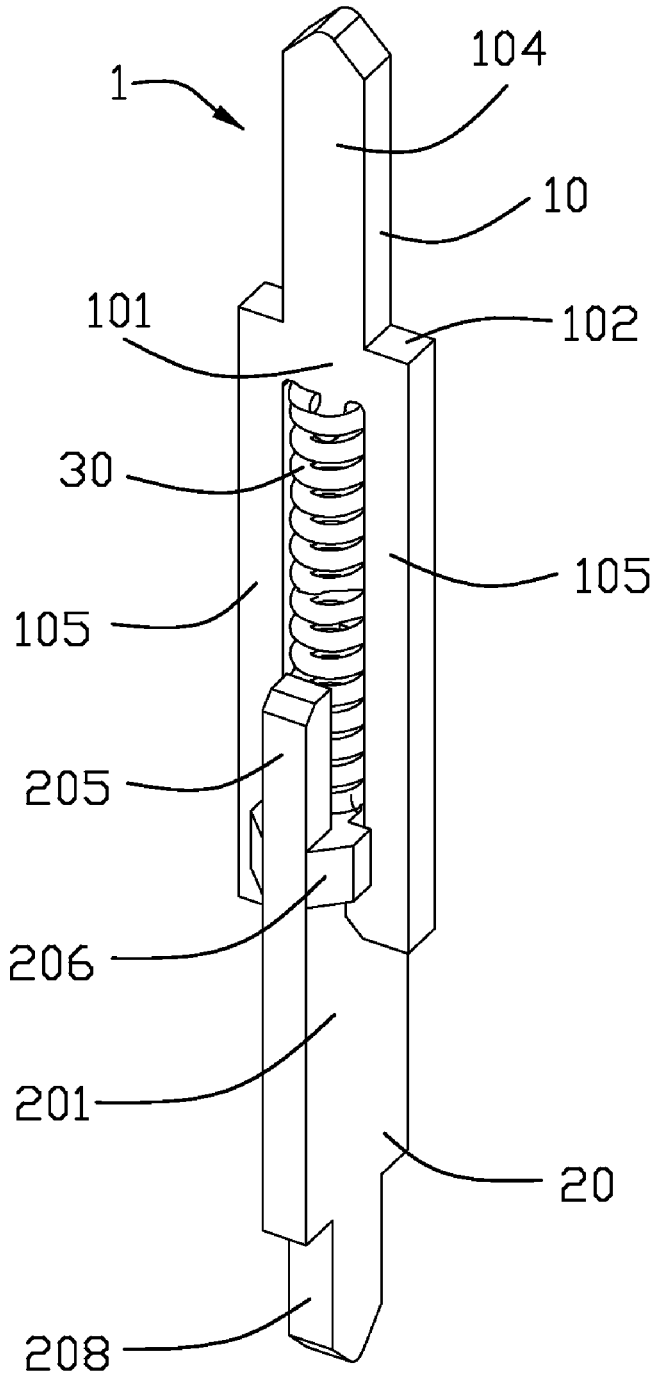
FIG. 1 is a perspective, assembled view of an electrical contact according to the present invention when the electrical contact is in initial state.

Referring to FIGS. 1-4, an electrical connector 100 of the present invention, used for connecting a central processing unit (CPU, not shown) with a printed circuit board (PCB, not shown), is described as following: the electrical connector 100 comprises an insulative housing 2 with a plurality of passageways 21 therein and a plurality of contacts 1 received in corresponding passageways 21. The contact 1 comprises a moveable part 10, an immoveable part 20 and a biasing device 30. The biasing device 30 is fitted over by the moveable and immoveable parts 10, 20 and provides resilient force therebetween.

Figure 2:
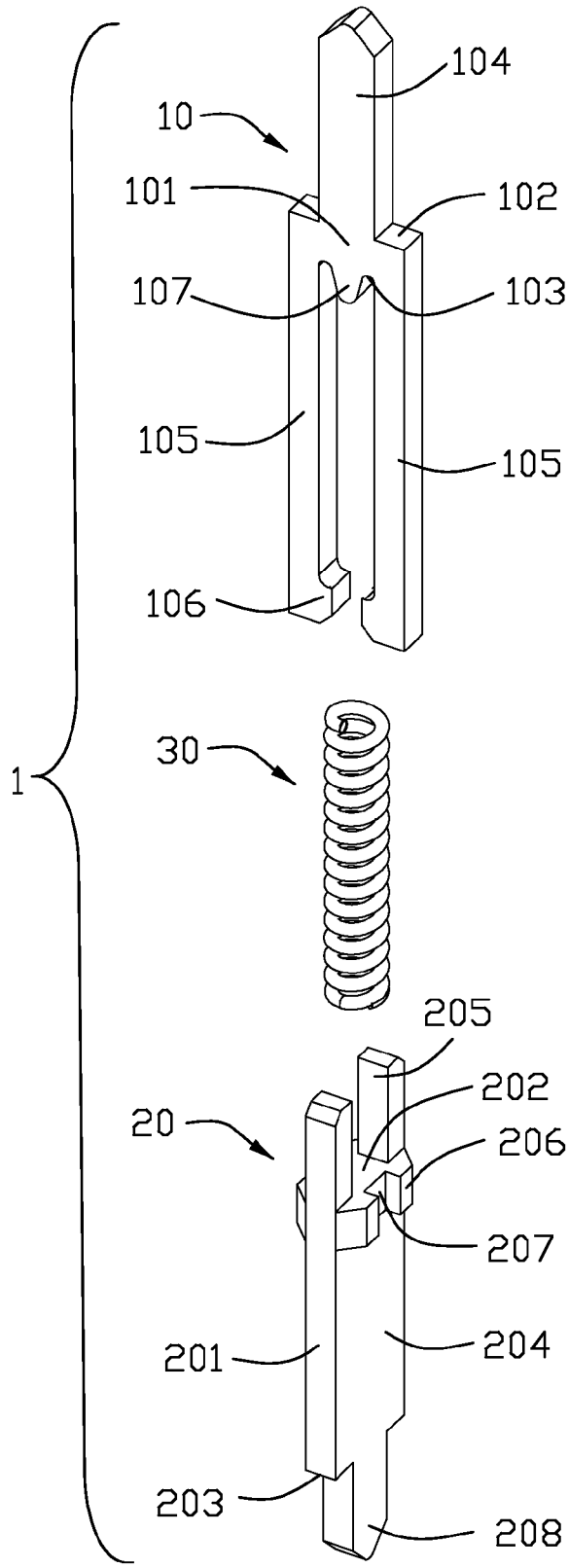
FIG. 2 is a perspective, exploded view of the electrical contact.
Figure 3:
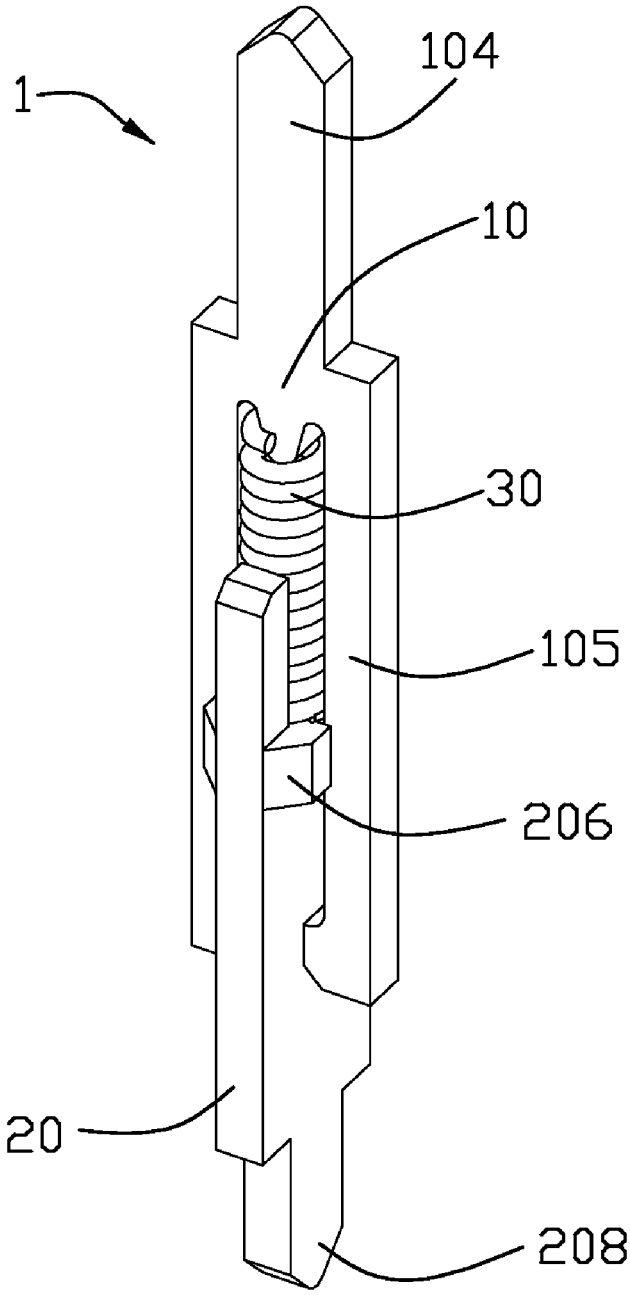
FIG. 3 is a perspective, assembled view of the electrical contact when the spring portion is compressed.
Figure 4:
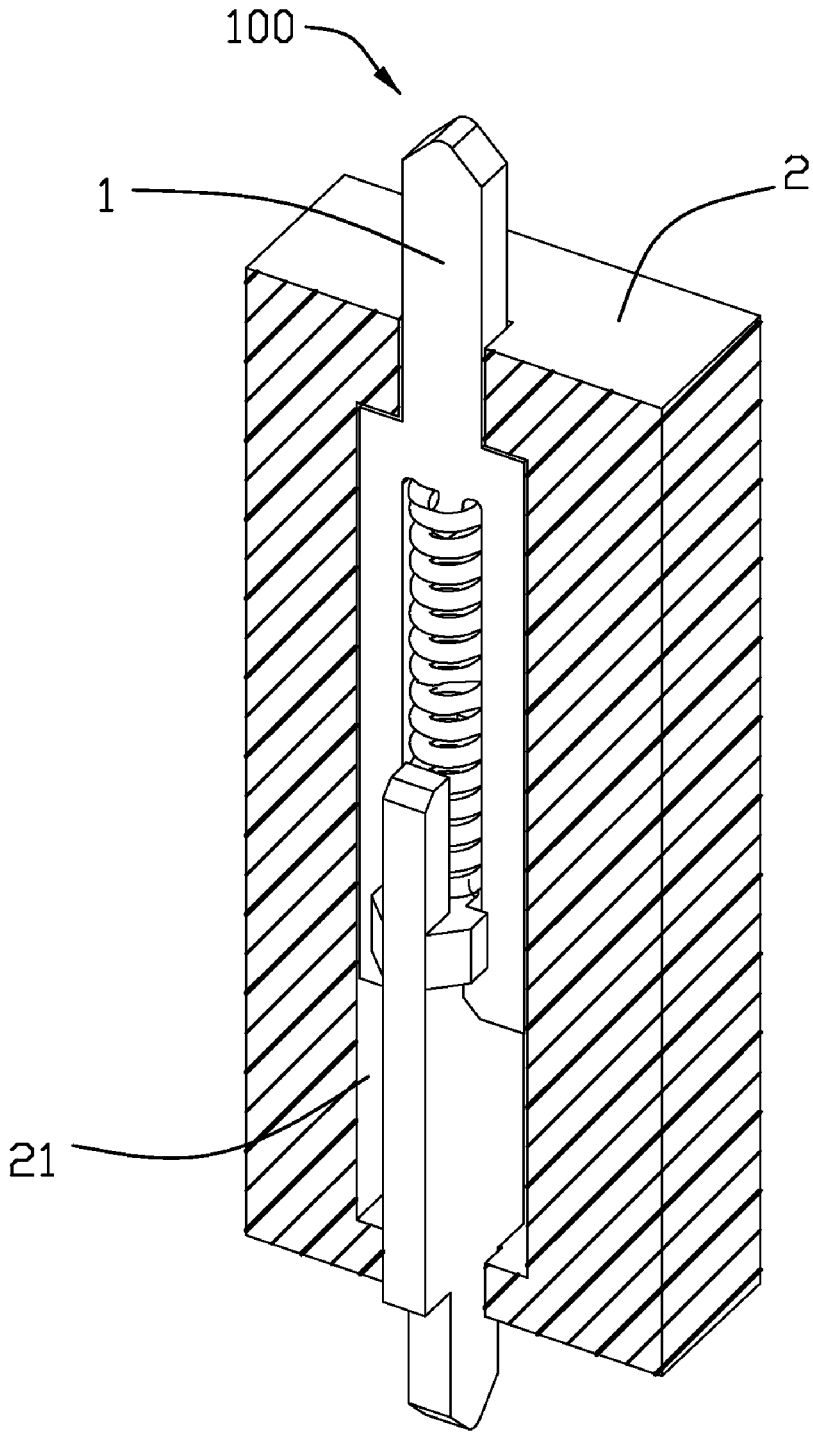
FIG. 4 is a cross section view of the contact received in the insulative housing.

Referring to FIG. 2, the moveable part 10 comprises a base portion 101. The base portion 101 defines an outer face 102 and an inner face 103 located at an opposite side of the outer face 102. The moveable part 10 further comprises a contact beam 104 extending upwardly from the outer face 102 for electrical connection with the CPU and a pair of guiding beams 105 extending downwardly from the inner face 103 for guiding purpose. The guiding beams 105 are parallel with each other. Each guiding beam 105 forms a hook portion 106 at a free end thereof. The moveable part 10 further forms a protrusion 107 from the inner face 103 which is arranged between the pair of guiding beams 105 and aligning with the guiding beams 105.

Referring to FIG. 2, the immoveable part 20 comprises a lengthwise main portion 204 with a top surface 202, a bottom surface 203 and a pair of lateral walls 201 connecting with the top surface 202 and the bottom surface 203. A pair of posts 205 continues to extend upwardly from the top surface 202 along with the lateral walls 201. An interspace (not labeled) is defined between the posts 205 for receiving the biasing device 30. The main portion 204 forms a pair of blocks 206 form opposite surfaces thereof. Each block 206 is mainly perpendicular to the main portion 204. The blocks 206 are located at a back-to-back state. A guiding slot 207 is defines on each block 206 with upper and lower openings thereof. A contact portion 208 extends downwardly from the bottom surface 203 for electrical connection with the PCB. The contact beam 104 and the contact portion 208 extend away from each other and extend along two different planes which are perpendicular to each other. The contact beam 104 and the contact portion 208 are described in different characters just for differentiation. The contact beam 104 and the contact portion 208 are both called contact beams, or called contact portions instead.

In assembling, the biasing device 30 is fitted in the moveable and immoveable parts 10, 20 with a lower end confronting the top surface 202 of the immoveable part 20 while an upper end confined by the protrusion 107 of the moveable part 10. The biasing device 30 is surrounded by the guiding beams 105 of the moveable part 10 and the posts 205 of the immoveable part 20 from four aspects. In an initial stage of assembling, the guiding beams 105 extend through the guiding slots 207 with elasticity and finally the hook portions 106 lock with the blocks 206 securely to prevent the moveable part 10 from deviating away from the immoveable part 20. When the CPU is connected with the contact beam 104, the moveable part 10 is suppressed to make the biasing device 30 in suppression thereby. In suppression, the guiding beams 105 move downwardly along the guiding slot 207 and the hook portions 106 are separated from the blocks 206 of the immoveable part 20. The hook portions 106 contact with the main portion 204 of the immoveable part 20. The moveable and immoveable parts 10, 20 return to the initial state when the CPU is removed due to the elasticity of the biasing device 30, again, the hook portions 106 are locked with the blocks 206. The guiding beams 105 are received in the guiding slots 207 and are capable of moving with regard to the immovable part 20 along opposite surfaces of the immoveable part 20.

The biasing device 30 of the contact 1 of the present invention is fitted over by the moveable and immoveable parts 10, 20, accordingly, the moveable and immoveable parts 10, 20 can have much more rigidity while keeping in small dimension in order to meet the minimization of the contact 1; the guiding beams 105 and the posts 205 are decussated to surround the biasing device 30, while furthermore, the biasing device 30 is confined by the protrusion 107, accordingly, the biasing device 30 is prevented from deviating therefrom; the hook portions 106 are engaged with the blocks 206 due to the elasticity of the guiding beams 105, the hook portions 106 have preformed holding force, accordingly, the hook portions 106 are engaged with the blocks 206 more reliable and the moveable and immoveable parts 10, 20 are prevented from deviating from each other even in very much great force. Moreover, the moveable and immoveable parts 10, 20 are both flat ones, accordingly, the contact 1 are easily molded and material-saving.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing defining a plurality of passageways;

a plurality of contacts received in corresponding passageways, each contact comprising:

a moveable part forming a pair of guiding beams;

an immoveable part coupled with the moveable part, comprising a pair of posts and defining a pair of guiding slots, the guiding beams received in the guiding slots and capable of moving with regard to the immovable part along opposite surfaces of the immoveable part; and a biasing device constantly urging the moveable part away from the immoveable part;

wherein the guiding beams and the posts are decussated to surround the biasing device for preventing the biasing device from disengaging therefrom.

2. The electrical connector as described in claim 1, wherein the immoveable part comprises a main portion, and the posts extend upwardly from the main portion.

3. The electrical connector as described in claim 2, wherein the immoveable part forms a pair of blocks protruding from the opposite surfaces of the main portion.

4. The electrical connector as described in claim 3, wherein the guiding slots are defined on the blocks and have upper and lower openings.

5. The electrical connector as described in claim 2, wherein the moveable part comprises a base portion and the guiding beams extend downwardly from the base portion.

6. The electrical connector as described in claim 5, wherein the base portion defines an inner face and forms a protrusion extending between and aligning with the guiding beams from the inner face.

7. The electrical connector as described in claim 6, wherein the protrusion partially protrudes into the biasing device.

8. The electrical connector as described in claim 3, wherein each guiding beam forms a hook portion engaging with the block and prevents deviation of the moveable part from the immovable part.

9. The electrical connector as described in claim 5, wherein the moveable part forms a contact beam extending oppositely relative to the guiding beams.

10. The electrical connector as described in claim 2, wherein the immoveable part comprises a contact portion extending oppositely relative to the posts.

11. The electrical connector as described in claim 1, wherein the immoveable part and the moveable part each form a contact portion extending away from each other.

12. The electrical connector as described in claim 11, wherein the two contact portions extend along two different planes, and wherein the two planes are perpendicular to each other.

13. A contact assembly comprising:

a first contact including a pair of guiding beams commonly defining a first space therebetween, each guiding beam forming a hook portion at a free end thereof;

a second contact defining a pair of posts commonly defining a second space therebetween, the second contact forming a pair of blocks on two opposite surfaces thereof;

said pair of guiding beams and said pair of posts being intersected with each other in a perpendicular manner under condition that said first contact and said second contact are back and forth moveable relative to each other in a vertical direction and the first space and the second space are interwoven with each other to commonly form a third space; wherein a coil spring is restrainedly positioned in said third space, and the hook portions engage with the blocks for preventing deviation of the first contact away from the second contact.

14. The contact assembly as claimed in claim 13, wherein said first contact includes a stud extending into one end of said coil spring.

15. The contact assembly as claimed in claim 13, wherein the second contact defines a pair of guiding slots in the blocks to guide movement of said pair of guiding beams in said vertical direction.

16. The contact assembly as claimed in claim 13, wherein said second contact defines a platform against which one end of the coil spring abuts.

17. The contact assembly as claimed in claim 13, wherein each of the first contact and the second contact comprises a pin-shaped contact portion.

* * * * *